United States Patent [19]

Inoue

[11] Patent Number: 4,830,431

[45] Date of Patent: May 16, 1989

[54] INTERLOCKING CUSHIONING MECHANISM FOR SUPPORTING SEAT PORTION AND BACKREST OF CHAIR IN INTEGRAL FASHION

[75] Inventor: Noboru Inoue, 5-6, Minamiazabu 3-chome, Minato-ku, Tokyo, Japan

[73] Assignees: Noboru Inoue; Itoki Co., Ltd., both of Japan

[21] Appl. No.: 127,084

[22] Filed: Dec. 1, 1987

[30] Foreign Application Priority Data

Aug. 24, 1987 [JP] Japan ..... 62-127520[U]

[51] Int. Cl.[4] ..... A47C 3/00

[52] U.S. Cl. ..... 297/300; 297/304

[58] Field of Search ..... 297/300, 301, 304

[56] References Cited

U.S. PATENT DOCUMENTS

| | | | |
|---|---|---|---|
| 4,451,085 | 5/1984 | Franck et al. | 297/300 |
| 4,471,994 | 9/1984 | Zund et al. | 297/300 |
| 4,629,249 | 12/1986 | Yamaguchi | 297/301 |
| 4,682,814 | 7/1987 | Hansen | 297/301 |
| 4,707,029 | 11/1987 | Korn | 297/301 |

*Primary Examiner*—Francis K. Zugel

*Attorney, Agent, or Firm*—Rogers & Killeen

[57] ABSTRACT

An interlocking cushioning mechanism for supporting a seat portion and a backrest of a chair in an integrally movable fashion. This mechanism has a primary mounting member secured to an upright support for swivel movement about the vertical axis thereof, slots formed in a portion of the primary mounting member which is located near the upper end of the upright support; a subsidiary mounting member having one end extending upwardly toward the rear of the chair and the other end secured to the slots by means of a shaft; a resilient member such as a spring held between the shaft and the forward end of the primary mounting member so as to cause the shaft to move rearwardly within the slot; a seat portion mounting frame for carrying the seat portion; and a backrest frame secured to the rear of the subsidiary mounting member. The resilient member is mounted by means of a simple mounting structure and the resilient force of the resilient member is altered with a minimal effort.

1 Claim, 3 Drawing Sheets

INTERLOCKING CUSHIONING MECHANISM FOR SUPPORTING SEAT PORTION AND BACKREST OF CHAIR IN INTEGRAL FASHION

BACKGROUND OF THE INVENTION

1. Field of the Invention

The present invention relates generally to cushioning mechanisms suitable for use with chairs such as office chairs and, more particularly, to cushioning mechanisms for their seat portions as well as interlocking cushioning mechanisms for supporting the seat portions to allow integral movement with their backrests.

2. Description of the Related Art

It is known that such a cushioning mechanism for a seat portion used, e.g., for an office chair typically incorporates a cushioning member such as a gas spring, a coil spring or a torsion bar.

Various types of interlocking cushioning mechanisms for supporting seat portions and backrests of chairs such as office chairs in an integral movable fashion have also heretofore been proposed. In such a conventional type of interlocking cushioning mechanism, the cushioning member for the seat portion is constituted by a gas spring, a coil spring or a torsion bar, and the cushioning member is linked with the backrest by a suitable link mechanism in an interlocking manner such as to mitigate the shock of the swinging motion of the backrest. Such an interlocking cushioning mechanism is disclosed, for example, in U.S. Pat. No. 4,533,177, Japanese Patent Laid-open No. 29304/1986, and Japanese Utility Model Laid-open No. 184451/1986.

It is also known that such a seat-portion cushioning mechanism employing a spring-type cushioning member has a mechanism that is arranged to allow users to alter the degree of hardness and the magnitude of resilient force of the cushioning member. However, this mechanism has a complicated structure and a large size and thus requires a large number of parts. As a result, the spring-tupe cushioning member involves various failure factors and its motion is likely to lack smoothness.

In particular, cushioning mechanisms of the type employing a spring incorporated in the frame of a support portion or a seat portion of a chair require complicated structures.

In addition, conventional types of interlocking cushioning mechanisms for supporting seat portions for integral movement with backrests in an interlocking manner involve the problem that their interlocking mechanisms are complicated. Interlocking cushioning mechanisms of another type which allows users to alter the degree of cushioning effect, such as the hardness or resilient force of a spring incorporated therein, require a complicated structure and a large size as well as a large number of parts. As a result, this type of mechanism involves various failure factors and its motion is likely to lack smoothness.

SUMMARY OF THE INVENTION

It is therefore an object of the present invention to provide a cushioning mechanism employing a coil spring or a cushioning member equivalent thereto and suitable for use with a seat portion of a chair, the coil spring or cushioning member being incorporated in a frame as one constituent member and the degree of resilient force of the coil spring or cushioning member being adjustable in spite of having a simple structure that is constituted by a reduced number of parts.

It is another object of the present invention to provide an interlocking cushioning mechanism employing a cushioning member such as a coil spring and suitable for supporting a seat portion of a chair to allow integral movement with a backrest thereof, the cushioning member being mounted by means of a simple mounting structure and the resilient force of the cushioning member being altered with a minimal effort.

According to the present invention, these objects are accomplished by providing an interlocking cushioning mechanism for supporting a seat portion and a backrest of a chair in an integral movable fashion, comprising an upright support; a primary mounting member secured to an upper end of the upright support for swivel movement about the vertical axis thereof, the primary mounting member being inclined upwardly toward the front of the chair; a slot formed in a portion of the primary mounting member which is located in the vicinity of the upper end of the upright support to which the primary mounting member is secured for swivel movement about the upright support; a subsidiary mounting member having a forward end located on the side of the upright support opposite to a forward end of the primary mounting member and an opposite end secured to the slot by means of a shaft extending substantially parallel to the front and rear ends of the seat portion; a resilient member having an adjustable resilient force and held under compression between the shaft and the forward end of the primary mounting member, the resilient member acting to cause the shaft to move rearwardly within the slot; a seat portion mounting frame disposed across the opposite forward ends of the primary mounting member and the subsidiary mounting member for carrying the seat portion; and a backrest frame secured to the forward end of the subsidiary mounting member.

When a load is applied to the seat-portion mounting frame, this frame moves downwardly pivotally about a mounting shaft of the primary mounting member. The downward movement of the seat-portion mounting frame is transmitted to the subsidiary mounting member connected pivotally to the rearward end of this frame and thus the mounting shaft of the subsidiary member is slided forwardly with the slots formed in the primary member at the position at which the subsidiary member is secured to the primary member. This sliding movement is cushioned since the resilient force of the resilient member such as a spring is applied to the mounting shaft of the subsidiary member on its front side.

These and other objects, features and advantages of the present invention will become apparent from the following detailed descriptions of a preferred embodiment thereof taken in conjunction with the accompanying drawings.

DESCRIPTION OF THE PREFERRED EMBODIMENT

Figure 1:
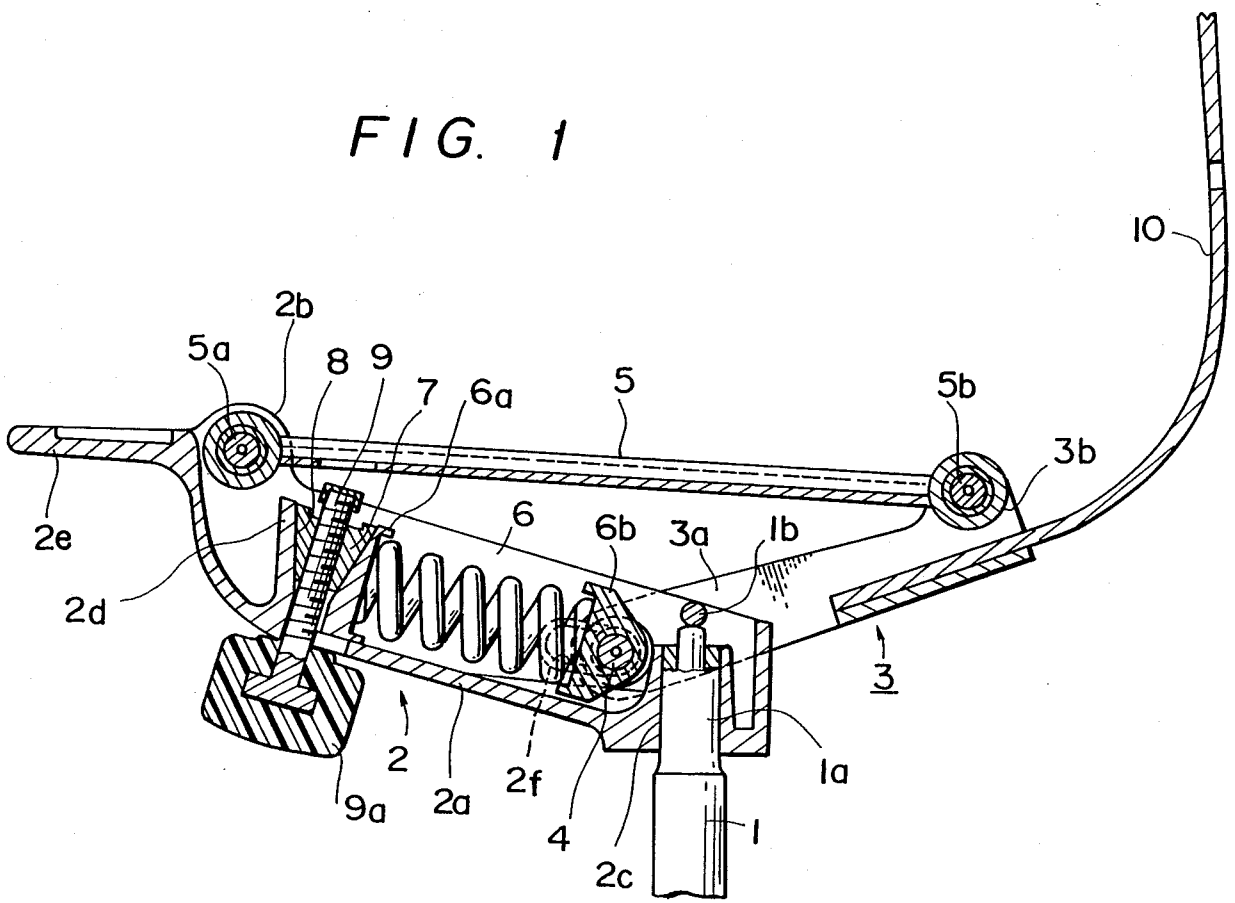
FIG. 1 is a diagrammatic side elevation in cross section of a preferred embodiment of a mechanism of the present invention.

In the drawings, an upright support for a swivel chair typically used in an office is indicated at 1, and its upper end is formed into a tapered portion 1*a* for supporting a primary mounting member 2 (which will be described later) for swivel motion about the vertical axis of the upright support 1. A knob 1*c* for adjustment of the height of the chair projects upwardly from the upper end, and a lever 1*b* provided on the primary mounting member 2 abuts against the upper end of the knob 1*c*.

The primary mounting member 2 which is fitted onto the upright support 1 for swivel motion about the vertical axis thereof includes a body 2*a* of die-cast aluminium having a flat box-like form with an open top and a closed bottom. Shaft mounting portions 2*b* for holding a horizontally extending shaft 5*a* (extending in a direction perpendicular to the plane of the cross-section shown in FIG. 1) is formed at the left-hand upper end portion of the body 2 as viewed in the drawings, and an upright mounting hole 2*c* for receiving the upright support 1 is formed at a right-hand end portion of the bottom of the body 2.

A spring supporting wall 2*d* is formed in the body 2*a* at a position generally below the shaft mounting portion 2*b* and in a tilted manner such as to support a compression spring 6 serving as a resilient member which will be described later. A tongue 2*e* extends substantially horizontally from the left-hand end of the body 2*a* (on the left side of the drawings) so as to support the front of a seat portion (not shown). Slots 2*f* are formed in the side wall of the body 2*a* in the vicinity of the mounting hole 2*c*, and a subsidiary mounting member 3 which will be described later is linked to the body 2*a* via the slots 2*f*. Each of the slots 2*f* is arranged to slope upwardly in the forward direction.

The subsidiary mounting member 3 has arm portions 3a extending to the left as viewed in the drawings, and a rear portion of the primary mounting member 2 is held between the arm portions 3*a*. Shaft mounting portions 3*b* are formed on the right-hand upper end of the subsidiary mounting member 3 in a similar manner to that of the shaft mounting portions 2*b*, and supports a mounting shaft 5*b* located parallel to the axis of the mounting shaft 5*a*.

The forward ends of the arm portions 3*a* of the subsidiary mounting member 3 are attached to a connecting rod 4 journalled in the slots 2*f*.

The primary member 2 and the subsidiary member 3 are mounted on the upright support 1 in this manner, and the shaft mounting portions 2*b* and 3*b* are located substantially parallel to the front and rear edges of the seat portion (not shown). A seat-portion mounting frame 5 for carrying the seat portion is mounted on the shaft mounting portions 2*b* and 3*b* by means of the mounting shafts 5*a* and 5*b*.

Figure 3:
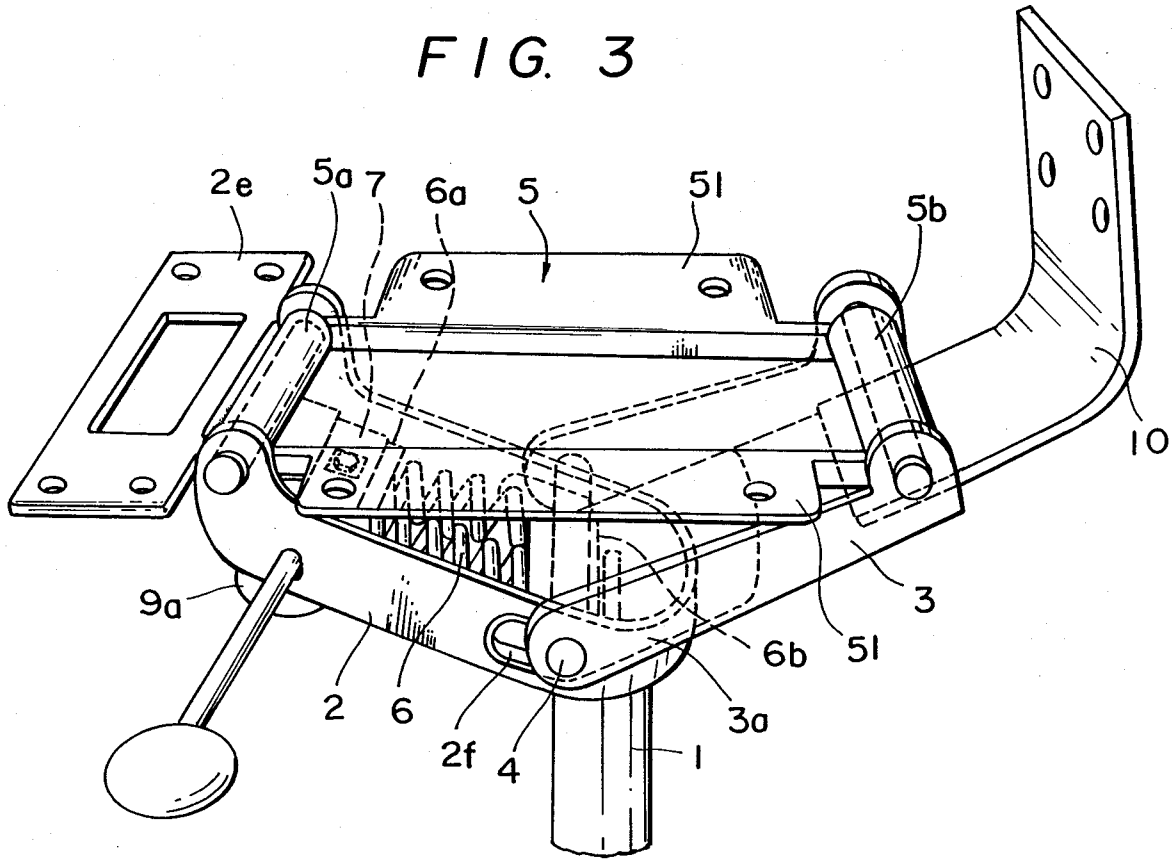
FIG. 3 is a diagrammatic perspective view of the mechanism in FIG. 1 as viewed from one side thereof.

The length of the seat-portion mounting frame 5 is selected so that the frame 5 can be mounted in position to maintain the subsidiary mounting member 3 in the state of being inclined upwardly in the forward direction as shown in FIG. 1. The frame 5 is integrally formed as shown in FIG. 3, but may be constituted by a combination of right and left separate parts as viewed from the front.

The compression spring 6 is held under compression between the spring supporting wall 2*d* and the connecting rod 4 within the body 2*a* of the primary mounting member 2. A front spring support 6*a* is located at a position close to and rearward of the spring supporting wall 2*d*. The front spring support 6*a* has a face opposing the spring supporting wall 2*d* and inclined in a direction inverse to that of the inclination of the wall 2*d*. A rear spring support 6*b* is fitted onto the connecting rod 4. Therefore, more specifically, the coiled compression spring 6 is held under compression between the front and rear spring supports 6*a* and 6*b*.

When a load such as the weight of a person is applied to the seat portion (not shown) and the load acts on the rear spring support 6*b* via the subsidiary mounting member 3, the compression spring 6 resiliently bears that load. Accordingly, any type of member that has a similar function may be employed, such as an assembly including a gas spring, a leaf spring or other suitable resilient members.

A cavity 8 having a tapered form in cross section and extending parallel to the front and rear edges of the chair is defined by the opposing faces of the spring supporting wall 2*d* and the front spring support 6*a*, and a wedge member 7 is fitted into the cavity. The wedge member 7 is moved upwardly and downwardly within the cavity 8 to cause the front spring support 2*a* to move forwardly and reawardly with respect to the compression spring, thereby enabling the degree of compression of the compression spring 6 to be altered.

In this embodiment, the wedge member 7 has a vertically extending internally threaded through-hole, and an adjustment screw rod 9 is screwed into the through-hole through the bottom of the body 2a of the primary mounting member 2. The screw rod 9 is turned to cause the wedge member 7 to move upwardly and downwardly within the cavity 8. This movement is performed by operating a knob or lever 9*a* provided at the lower end of the screw rod 9.

A backrest mounting frame 10 is mounted on the subsidiary mounting member 3 at a rearward portion thereof and is capable of moving integrally with the subsidiary mounting member 3.

The following is a description of the presently preferred embodiment of the mechanism of the invention constructed by a combination of the above-described components.

While no load is being applied to the seat portion (not shown), the present inventive mechanism is in the position shown in FIG. 1.

When a person sits on the chair, the weight of the person is applied as a load to the seat-portion mounting frame 5. Thus the frame 5 is angularly rotated about the front mounting shaft 5*a* in the clockwise direction. This angular rotation causes the connecting rod 4 provided at the forward end of the subsidiary mounting member 3 to slide forwardly within the slots in the primary mounting member 2, thereby causing forward sliding movement of the subsidiary mounting member 3.

During the forward sliding movement of the member 3, the connecting rod 4 is pressed rearwardly by the resilient force of the compression spring 6. Therefore, the forward sliding movement is cushioned by the resilient force.

As the wedge member 7 moves upwardly within the cavity 8, the resilient force of the compression spring 6 increases, while as the member 7 moves downwardly, the resilient force decreases. Accordingly, the user can adjust the cushioning effect of the mechanism to a desired extent.

Figure 2:
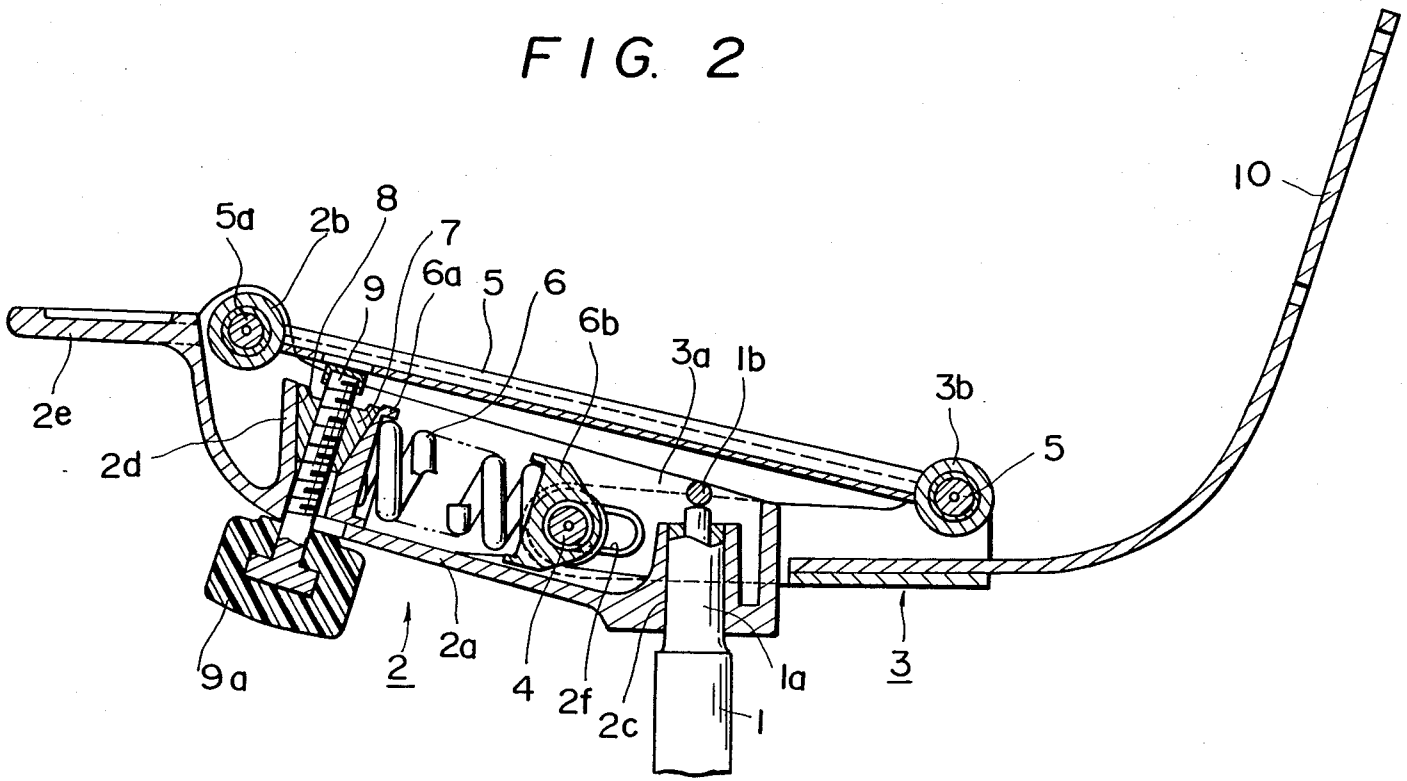
FIG. 2 is a diagrammatic side elevation in cross section of the mechanism in FIG. 1 in its operated state.

When the seat-portion mounting frame 5 is moved to its lowest position by the load acting upon the seat portion, the subsidiary mounting member 3 reaches the position shown in FIG. 2.

During this movement, the backrest mounting frame 10 moves integrally with the subsidiary mounting member 3 and is tilted downwardly.

In the above-described embodiment, the slots 2*f* are sloped upwardly in the forward direction so that the angle through which the seat portion mounting frame 5 moves downwardly may be equal to the angle through which the backrest mounting frame 10 is tilted in interlocking relationship with the movement of the frame 5 through the subsidiary mounting member 3 in relation to the spacing between the shafts 5*a* and 5*b* of the seat-portion mounting frame 5 as well as the spacing between the shaft 5*b* and the shaft 4 of the subsidiary member 3.

Accordingly, the relationship between the angle of downward movement and the angle of tilting during interlocking motion of the frames 5 and 10 can be freely set by adjusting the spacing between the mounting shafts 5*a* and 5*b* of the frame, the spacing between the shafts 5*b* and 4 of the subsidiary mounting member 3, and the tilting of the slots 2*f*.

As described above, in accordance with the present invention, the interlocking cushioning mechanism for supporting the seat portion and the backrest in an integral movable fashion is constituted by a significantly reduced number of parts and thus has a simple structure. Accordingly, it is possible to provide compact and smoothly operable cushioning mechanisms which are manufactured with ease and at low cost.

The seat portion mounting frame is formed so that the portion of the seat portion excluding its forward end may move downwardly at a slant. Accordingly, it is possible to eliminate the problem of the thighs of the user sitting on the chair being pressed by the front of the seat portion when the seat sinks deeply.

The present invention having the above-described arrangement offers significantly utility as a cushioning mechanism for use with office chairs.

What is claimed is:

1. An interlocking cushioning mechanism for supporting a seat portion and a backrest of a chair in an integrally movable fashion, comprising:

an upright support;

a longitudinally extending primary mounting member having a forward end and an opposite end, said primary mounting member being secured at said opposite end to an upper end of said upright support for swivel movement about the vertical axis thereof, and said primary mounting member being forwardly inclined upwardly toward the front of said chair;

a slot formed in a portion of said primary mounting member which is located in the vicinity and forward of said upper end of said upright support to which said primary mounting member is secured for swivel movement about said upright support, the longitudinal axis of said slot extending parallel with the longitudinal axis of said primary mounting member;

a subsidiary mounting member having a rearward end located on the side of said upright support opposite to said forward end of said primary mounting member and a forward end secured to said slot by means of a shaft extending normal to the longitudinal axis of said slot, and the vertical axis of said upright support;

a resilient member positioned within the body of said primary mounting member and held under compression between said shaft and said forward end of said primary mounting member and acting to cause said shaft to move rearwardly within said slot, the direction of action of said resilient member being parallel to the longitudinal axis of said primary mounting member, and the degree of resilient force of said resilient member being adjustable;

a seat portion mounting frame disposed across said opposite forward end of said primary mounting member and said rearward end of said subsidiary mounting member for carrying a seat portion; and a backrest frame secured to said rearward end of said subsidiary mounting member.

* * * * *